US012385339B2

(12) United States Patent
Gar et al.

(10) Patent No.: US 12,385,339 B2
(45) Date of Patent: Aug. 12, 2025

(54) INTERNAL SLIP INCLUDING ONE OR MORE SYMMETRICAL TEETH

(71) Applicant: Halliburton Energy Services, Inc., Houston, TX (US)

(72) Inventors: Shobeir Pirayeh Gar, Carrollton, TX (US); Xiaoguang Allan Zhong, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 11 days.

(21) Appl. No.: 18/073,771

(22) Filed: Dec. 2, 2022

(65) Prior Publication Data

US 2024/0183235 A1 Jun. 6, 2024

(51) Int. Cl.
*E21B 23/01* (2006.01)
*E21B 33/10* (2006.01)
*E21B 40/00* (2006.01)

(52) U.S. Cl.
CPC ..... *E21B 23/01* (2013.01); *E21B 33/10* (2013.01); *E21B 40/001* (2020.05)

(58) Field of Classification Search
CPC ..... E21B 23/01; E21B 40/001; E21B 33/10
See application file for complete search history.

(56) References Cited

U.S. PATENT DOCUMENTS 2,887,754 A * 5/1959 Johnson ..... E21B 33/0422 285/123.8
2,998,073 A * 8/1961 Clark, Jr. ..... E21B 33/1292 166/134
3,344,861 A * 10/1967 Claycomb ..... E21B 33/1295 166/134
5,301,760 A * 4/1994 Graham ..... E21B 29/06 166/386
5,311,936 A 5/1994 McNair et al.
(Continued)

FOREIGN PATENT DOCUMENTS

WO 2015030958 A1 3/2015
WO 2015094338 A1 6/2015

*Primary Examiner* — D. Andrews
(74) *Attorney, Agent, or Firm* — Scott Richardson; Parker Justiss, P.C.

(57) ABSTRACT

Provided is an internal slip, a sealing/anchoring subassembly, a well system, and method. The internal slip, in one aspect, includes a tubular, the tubular having a tubular inner diameter ($ID_t$) and a tubular outer diameter ($OD_t$). The internal slip, in this aspect, further includes a first set of teeth disposed along the tubular inner diameter ($ID_t$), the first set of teeth configured to engage with base teeth disposed on a base outer diameter ($OD_B$) of a base positioned radially inside of the tubular. The internal slip, in this aspect, further includes a second set of teeth disposed along the tubular outer diameter ($OD_t$), the second set of teeth configured to engage with stroke sleeve teeth disposed on a stroke sleeve outer diameter ($OD_{SS}$) of a stroke sleeve positioned radially outside of the tubular, wherein one or more of the second set of teeth are generally symmetrical about a centerline thereof.

10 Claims, 19 Drawing Sheets

(56) References Cited

U.S. PATENT DOCUMENTS

| | | | |
|---|---|---|---|
| 5,343,954 | A | 9/1994 | Bohlen et al. |
| 5,433,275 | A | 7/1995 | Melenyzer et al. |
| 10,590,732 | B2 | 3/2020 | Ingram |
| 2010/0101806 | A1 | 4/2010 | Millet et al. |
| 2011/0095485 | A1 | 4/2011 | Saylor et al. |
| 2011/0284208 | A1 | 11/2011 | Macleod et al. |
| 2015/0198005 | A1 | 7/2015 | Delzell et al. |
| 2018/0252074 | A1 | 9/2018 | Hughes et al. |
| 2019/0072215 | A1* | 3/2019 | Douglas ..... E21B 17/042 |
| 2019/0186232 | A1 | 6/2019 | Ingram |

* cited by examiner

INTERNAL SLIP INCLUDING ONE OR MORE SYMMETRICAL TEETH

BACKGROUND

The unconventional market is very competitive. The market is trending towards longer horizontal wells to increase reservoir contact. Multilateral wells offer an alternative approach to maximize reservoir contact. Multilateral wells include one or more lateral wellbores extending from a main wellbore. A lateral wellbore is a wellbore that is diverted from the main wellbore or another lateral wellbore.

The lateral wellbores are typically formed by positioning one or more deflector assemblies at desired locations in the main wellbore (e.g., an open hole section or cased hole section of the main wellbore) with a running tool. The deflector assemblies are often laterally and rotationally fixed within the main wellbore using a wellbore anchor, sealed using a wellbore seal, and then used to create an opening in the casing.

BRIEF DESCRIPTION

Reference is now made to the following descriptions taken in conjunction with the accompanying drawings, in which.

DETAILED DESCRIPTION

Figure 1:
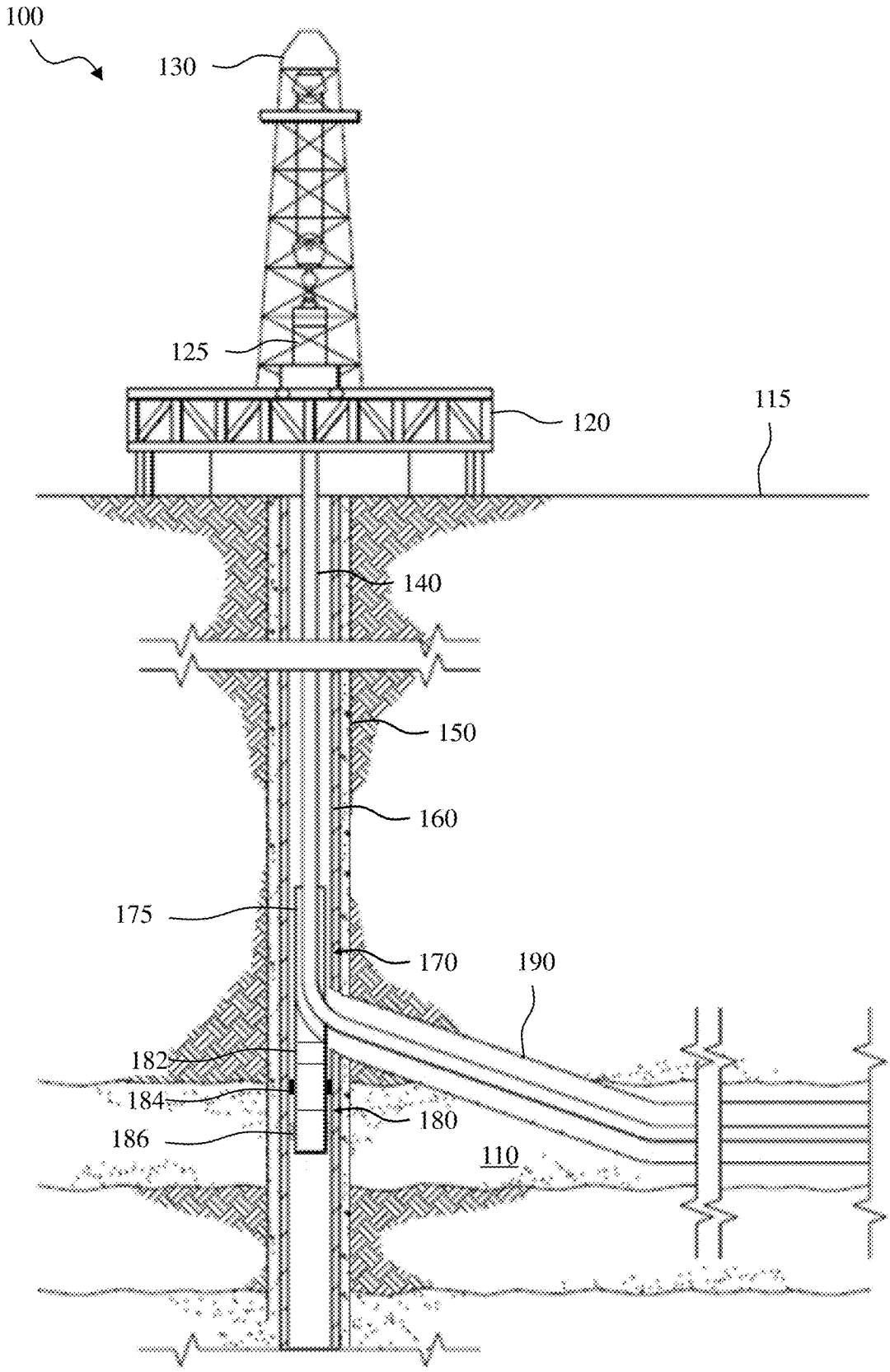
FIG. 1 illustrates a schematic view of a well system designed, manufactured and operated according to one or more embodiments disclosed herein.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect." "engage," "couple." "attach," or any other like term describing an interaction between elements is not meant to limit the interaction to direct interaction between the elements and may also include indirect interaction between the elements described. Unless otherwise specified, use of the terms "up," "upper." "upward." "uphole." "upstream," or other like terms shall be construed as generally away from the bottom, terminal end of a well; likewise, use of the terms "down," "lower," "downward," "downhole." "downstream," or other like terms shall be construed as generally toward the bottom, terminal end of a well, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water such as ocean or fresh water.

The present disclosure is based, at least in part, on the acknowledgment that internal slips are an important part of a sealing/anchoring subassembly such as packer system, for example being used to hold the setting load once the sealing/anchoring subassembly is set and prior to differential pressure application. However, backlash or set back of the internal slip is an inherent drawback of common locking systems, resulting in some loss in setting force and subsequent relaxation of the packer element, which eventually affects the packer sealing performance (e.g., particularly for large size packers).

The present disclosure has recognized that one way to control and limit the backlash is to refine the teeth of the internal slip. For example, the present disclosure has developed a new internal slip that includes a set of teeth on an outer diameter (OD) thereof, one or more of the set of teeth being generally symmetrical about a centerline thereof. The phrase "generally symmetrical", as used herein, means that the one or more of the set of teeth are symmetrical within 20 percent about the centerline thereof. In yet another embodiment, the present disclosure has developed a new internal slip that includes a set of teeth on an outer diameter (OD) thereof, one or more of the set of teeth being substantially symmetrical about the centerline thereof. The phrase "substantially symmetrical", as used herein, means that the one or more of the set of teeth are symmetrical within 10 percent about the centerline thereof. In yet even another embodiment, the present disclosure has developed a new internal slip that includes a set of teeth on an outer diameter (OD) thereof, one or more of the set of teeth being ideally symmetrical about the centerline thereof. The phrase "ideally symmetrical", as used herein, means that the one or more of the set of teeth are symmetrical within 3 percent about the centerline thereof.

The present disclosure has determined that a internal slip with the symmetrical teeth provides more geometrical constraint that enhances the ratcheting stiffness, which in turn substantially reduces the aforementioned backlash. What results is improved sealing performance, for example as a result of reducing the backlash. Additionally, the scaling/anchoring subassembly according to the present design is simple, for example with no manufacturing design complexities, as well as is a versatile concept that can easily be applied to other packer systems.

The disclosure, in one embodiment, also describes a new method for deploying, setting, and retrieving one or more features of a whipstock assembly, as might be used to form a lateral wellbore from a main wellbore. In at least one embodiment, the whipstock assembly includes a scaling/anchoring subassembly, the sealing/anchoring subassembly including an orienting receptacle section, a sealing section, and a latching element section. In accordance with one embodiment of the disclosure, the orienting receptacle section, along with a collet and one or more orienting keys, may be used to land and position a guided milling assembly within the casing, the guided milling assembly ultimately being used to generate a pocket in the casing. In accordance with one other embodiment of the disclosure, the orienting receptacle section, along with the collet and one or more orienting keys, may be used to land and position a whipstock element section of the whipstock assembly within the casing (e.g., the whipstock element section ultimately being used to form a lateral wellbore off of the main wellbore), and cement a multilateral junction between the two.

In at least one embodiment, the sealing section may employ any known or hereafter discovered sealing elements capable of setting and/or sealing the sealing section. For example, in at least one embodiment, the sealing elements are polymer sealing elements set with a mechanical axial load about a mandrel. Ultimately, unless otherwise required, the present disclosure is not limited to any specific sealing elements.

FIG. 1 is a schematic view of a well system 100 designed, manufactured and operated according to one or more embodiments disclosed herein. The well system 100 includes a platform 120 positioned over a subterranean formation 110 located below the earth's surface 115. The platform 120, in at least one embodiment, has a hoisting apparatus 125 and a derrick 130 for raising and lowering one or more downhole tools including pipe strings, such as a drill string 140. Although a land-based oil and gas platform 120 is illustrated in FIG. 1, the scope of this disclosure is not thereby limited, and thus could potentially apply to offshore applications. The teachings of this disclosure may also be applied to other land-based well systems different from that illustrated.

As shown, a main wellbore 150 has been drilled through the various earth strata, including the subterranean formation 110. The term "main" wellbore is used herein to designate a wellbore from which another wellbore is drilled. It is to be noted, however, that a main wellbore 150 does not necessarily extend directly to the earth's surface but could instead be a branch of yet another wellbore. A casing string 160 may be at least partially cemented within the main wellbore 150. The term "casing" is used herein to designate a tubular string used to line a wellbore. Casing may actually be of the type known to those skilled in the art as a "liner" and may be made of any material, such as steel or composite material and may be segmented or continuous, such as coiled tubing. The term "lateral" wellbore is used herein to designate a wellbore that is drilled outwardly from its intersection with another wellbore, such as a main wellbore. Moreover, a lateral wellbore may have another lateral wellbore drilled outwardly therefrom.

In the embodiment of FIG. 1, a whipstock assembly 170 according to one or more embodiments of the present disclosure is positioned at a location in the main wellbore 150. Specifically, the whipstock assembly 170 could be placed at a location in the main wellbore 150 where it is desirable for a lateral wellbore 190 to exit. Accordingly, the whipstock assembly 170 may be used to support a milling tool used to penetrate a window in the main wellbore 150, and once the window has been milled and a lateral wellbore 190 formed, in some embodiments, the whipstock assembly 170 may be retrieved and returned uphole by a retrieval tool.

The whipstock assembly 170, in at least one embodiment, includes a whipstock element section 175, as well as a sealing/anchoring subassembly 180 coupled to a downhole end thereof, the sealing/anchoring subassembly 180 designed, manufactured and/or operated according to one or more embodiments of the disclosure. The sealing/anchoring subassembly 180, in one or more embodiments, includes an orienting receptacle section 182, a sealing section 184, and a latching element section 186. The orienting receptacle section 182, in one or more embodiments, along with a collet and one or more orienting keys, may be used to land and positioned a guided milling assembly and/or the whipstock element section 175 within the casing string 160. The scaling section 184, in at least one embodiment, seals an annulus (e.g., provides a pressure tight seal) between the whipstock assembly 170 and the casing string 160. In at least one embodiment, the latching element section 186 axially, and optionally rotationally, fixes the whipstock assembly 170 within the casing string 160.

The elements of the whipstock assembly 170 may be positioned within the main wellbore 150 in one or more separate steps. For example, in at least one embodiment, the sealing/anchoring subassembly 180, including the orienting receptacle section 182, scaling section 184 and the latching element section 186 are run in hole first, and then set within the casing string 160. Thereafter, the sealing section 184 may be pressure tested. Thereafter, the whipstock element section 175 may be run in hole and coupled to the sealing/anchoring subassembly 180, for example using the orienting receptacle section 182. What may result is the whipstock assembly 170 illustrated in FIG. 1.

Figure 2A:
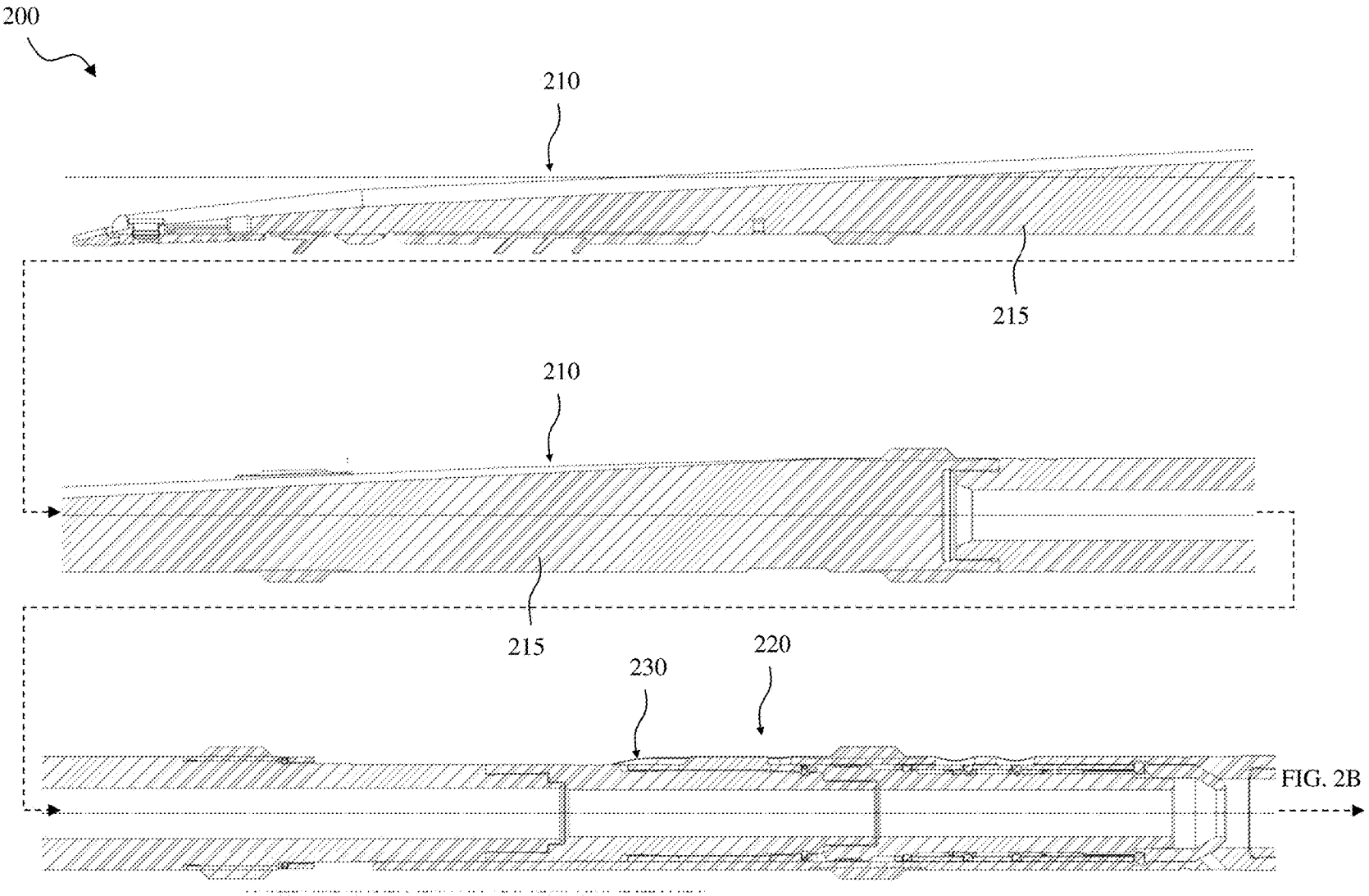
FIGS. 2A and 2B illustrate one embodiment of a whipstock assembly designed and manufactured according to one or more embodiments of the disclosure.
Figure 2B:
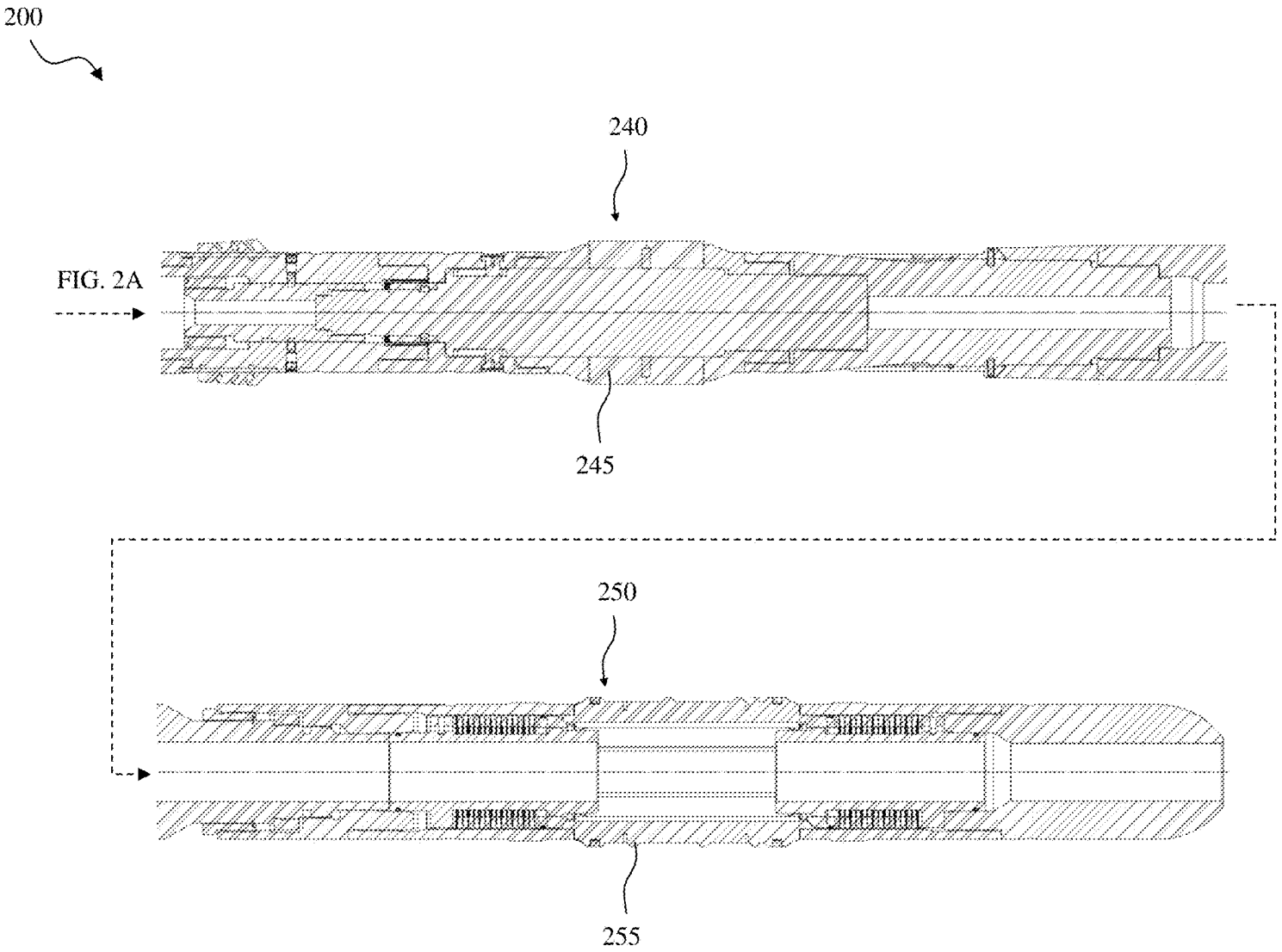

Turning now to FIGS. 2A and 2B, illustrated is one embodiment of a whipstock assembly 200 designed and manufactured according to one or more embodiments of the disclosure. The whipstock assembly 200, in the illustrated embodiment of FIGS. 2A and 2B, includes a whipstock element section 210, and a sealing/anchoring subassembly 220. The whipstock element section 210, in the illustrated embodiment, includes a whipstock element 215 (e.g., ramp element). The sealing/anchoring subassembly 220, in one or more embodiments, includes an orienting receptacle section 230 (e.g., including a muleshoe), a sealing section 240, and a latching element section 250. The scaling section 240, in the illustrated embodiment, among other features disclosed below, includes a sealing/anchoring element 245, the sealing/anchoring element 245 configured to move between a radially retracted state and a radially expanded state. The latching element section 250, in the illustrated embodiment, includes one or more latching features 255, the one or more latching features 255 configured to engage with a profile in a casing string.

Figure 3:
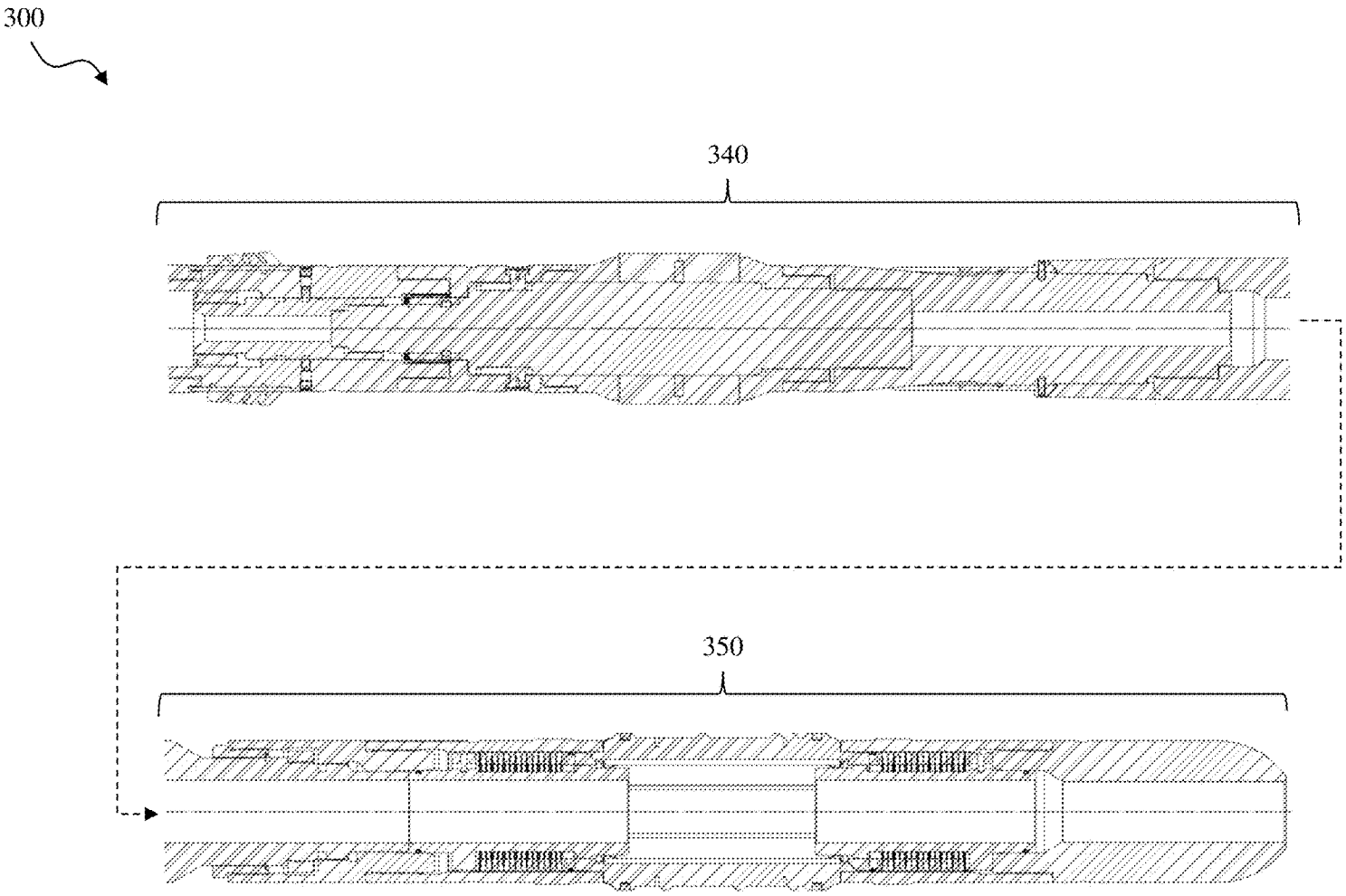
FIG. 3 illustrates an alternative embodiment of a sealing/anchoring subassembly, the sealing/anchoring subassembly including a sealing section and a latching element section designed and manufactured according to an alternative embodiment of the disclosure.

Turning to FIG. 3, illustrated is an alternative embodiment of a sealing/anchoring subassembly 300, the sealing/anchoring subassembly including a sealing section 340 and a latching element section 350 designed and manufactured according to an alternative embodiment of the disclosure. The sealing section 340, latching element section 350 and an orienting element section (not shown in FIG. 3) may be run in hole within a main wellbore, set, and then pressure tested, prior to a whipstock element section (not shown in FIG. 3) of the whipstock assembly being run in hole and attached with the sealing section 340 (e.g., engaged with the orienting element section attached to the sealing section 340). Notwithstanding, FIG. 3 illustrates the latching element section 350 in the engaged state, whereas the sealing section 340 is in the radially retracted state.

Turning to FIGS. 4A through 4E, illustrated are various different cross-sectional views of a portion of a sealing/anchoring subassembly 400 designed, manufactured and/or operated according to one or more embodiments of the disclosure. As is illustrated, in one or more embodiments, the sealing/anchoring subassembly 400 includes a mandrel 405 having a sealing/anchoring element 410 positioned thereabout. In at least one embodiment, the sealing/anchoring element 410 is configured to move between a radially retracted state and a radially expanded state.

The sealing/anchoring subassembly 400, in the illustrated embodiment, additionally includes one or more setting shear features 420. In one or more embodiments, the one or more setting shear features 420 are used to hold the scaling/anchoring element 410 in its radially retracted state while running in hole, and thus allowing a flow path for cleaning the wellbore.

The sealing/anchoring subassembly 400, in one or more embodiments, additionally includes a ratch latch body 430 designed, manufactured and/or operated according to one or more embodiments of the disclosure. In the illustrated embodiment, the ratch latch body 430 is coupled to the sealing/anchoring element 410, and is additionally configured to move and/or hold the sealing/anchoring element 410 in the radially expanded state. The ratch latch body 430 includes, in one or more embodiments, a stroke sleeve 440 having a stroke sleeve outer diameter ($OD_{SS}$) and a stroke sleeve inner diameter ($ID_{SS}$). Further to the embodiment of FIGS. 4A through 4E, the stroke sleeve inner diameter ($ID_{SS}$) has a plurality of stroke sleeve teeth 445 disposed thereon. As will be further understood below, in at least one embodiment one or more of the pluralities of stroke sleeve teeth 445 are generally symmetrical about a centerline thereof. In at least one embodiment, the stroke sleeve 440 additionally includes a pin section 450 having a plurality of pin threads 455 (e.g., acme pin threads), the pin threads 455 configured to engage with related box threads 465 (e.g., acme box threads) in a box section 460 of the scaling/anchoring subassembly 400, or vice versa.

The ratch latch body 430, in one or more embodiments, may further include a base 490 having a base outer diameter ($OD_B$) and a base inner diameter ($ID_B$). The base outer diameter ($OD_B$), in the illustrated embodiment, has a plurality of base teeth 495 disposed thereon. In one or more embodiments, such as shown, the plurality of base teeth 495 are conventional directionally angled base teeth, and thus are not generally symmetrical about a centerline thereof.

The ratch latch body 430, in one or more embodiments, additionally includes a internal slip 470 disposed radially between the stroke sleeve 440 and the base 490. The internal slip 470, in one or more embodiments, may include a tubular 472, the tubular 472 having a tubular inner diameter ($ID_t$) and a tubular outer diameter ($OD_t$). In accordance with at least one embodiment, the internal slip 470 further includes a first set of teeth 475 disposed along the tubular inner diameter ($ID_t$), the first set of teeth 475 configured to engage with the base teeth 495. In accordance with at least one other embodiment, the internal slip 470 includes a second set of teeth 480 disposed along the tubular outer diameter ($OD_t$), the second set of teeth 480 configured to engage with the stroke sleeve teeth 445.

As discussed above, in at least one embodiment one or more of the second set of teeth 480 are generally symmetrical about a centerline 482 thereof. Furthermore, in at least one embodiment, one or more of the second set of teeth 475 are substantially, if not ideally, symmetrical about the centerline 482. In the illustrated embodiment of FIGS. 4A through 4E, tips of the one or more of the second set of teeth 475 that are generally symmetrical are in a shape of a polygon. For example, in the embodiment of FIGS. 4A through 4E the tips are in the shape of a trapezoid, nevertheless other polygonal shapes are within the scope of the disclosure. Thus, in accordance with at least one embodiment, sidewalls 484 of the tips of the one or more of the second set of teeth 480 are angled relative to the centerline 482. Additionally, in at least one embodiment, the stroke sleeve teeth 445 (e.g., as they engage with the second set of teether 480) may also be generally symmetrical, substantially symmetrical, or ideally symmetrical (e.g., as those phrases are defined), such as to engage with the similarly shaped second set of teeth 480.

Further to the embodiment of FIGS. 4A through 4E, in at least one embodiment, the first set of teeth 475 are not generally symmetrical about a centerline 478 thereof. Thus, for example, the first set of teeth 475 could be directionally angled teeth, the directionally angled teeth better suited for ratcheting one direction than an opposite direction. In yet other embodiments, however, one or more of the first set of teeth 475 are generally symmetrical about a centerline 478 thereof.

Figure 4A:
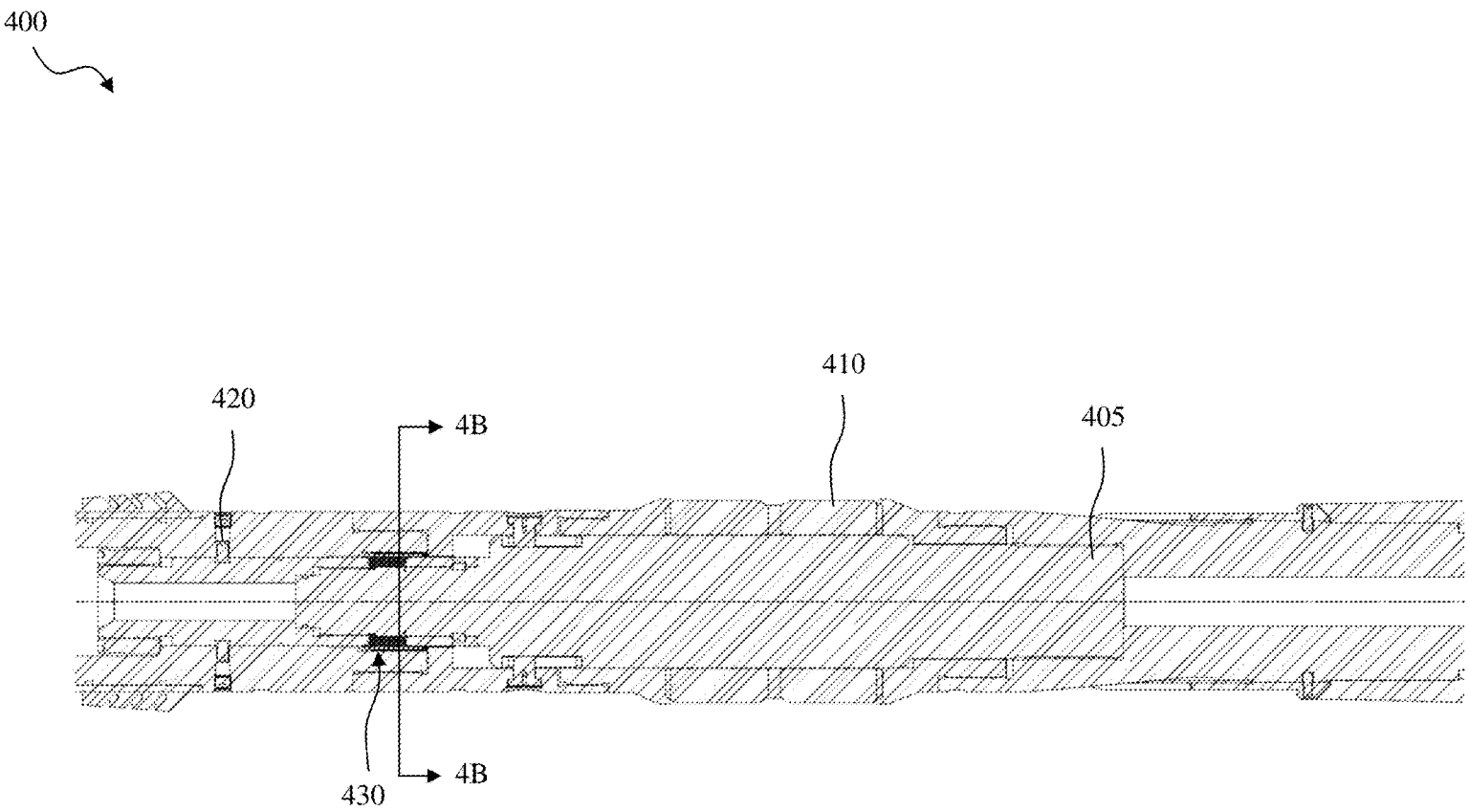
FIGS. 4A through 4E illustrate cross-sectional views of a portion of a sealing/anchoring subassembly designed and manufactured according to one or more embodiments of the disclosure.
Figure 4B:
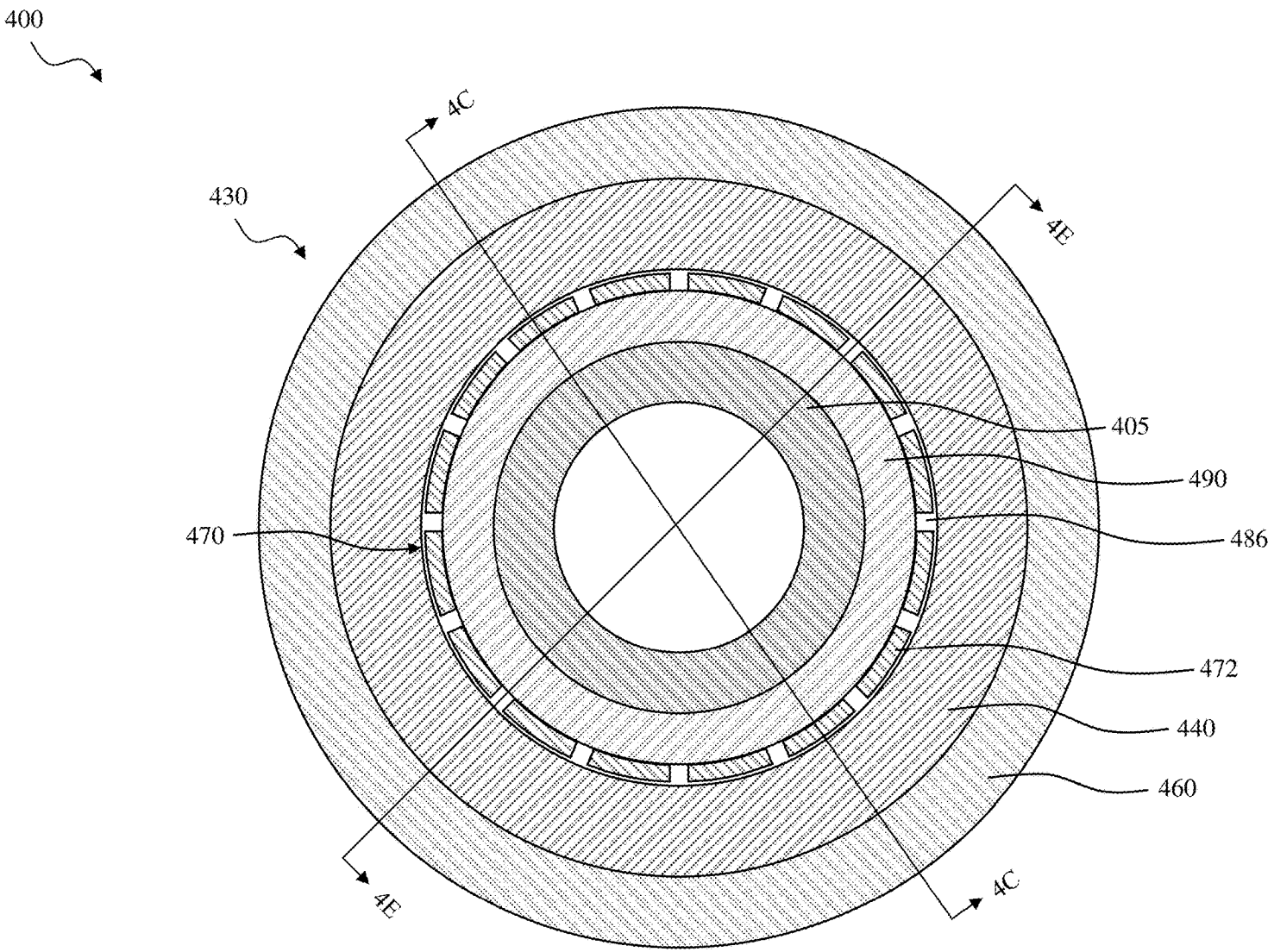
Figure 4C:
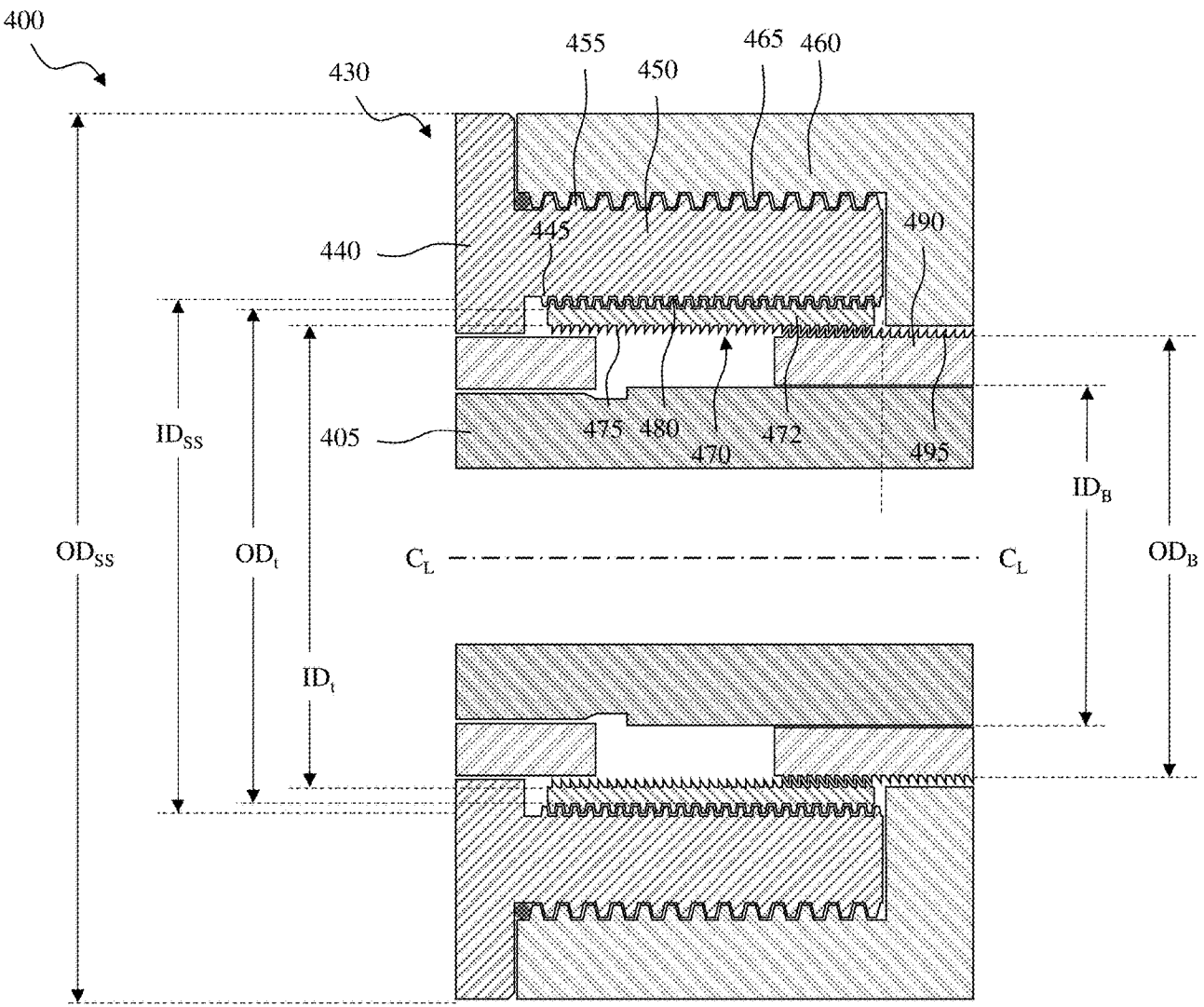
Figure 4D:
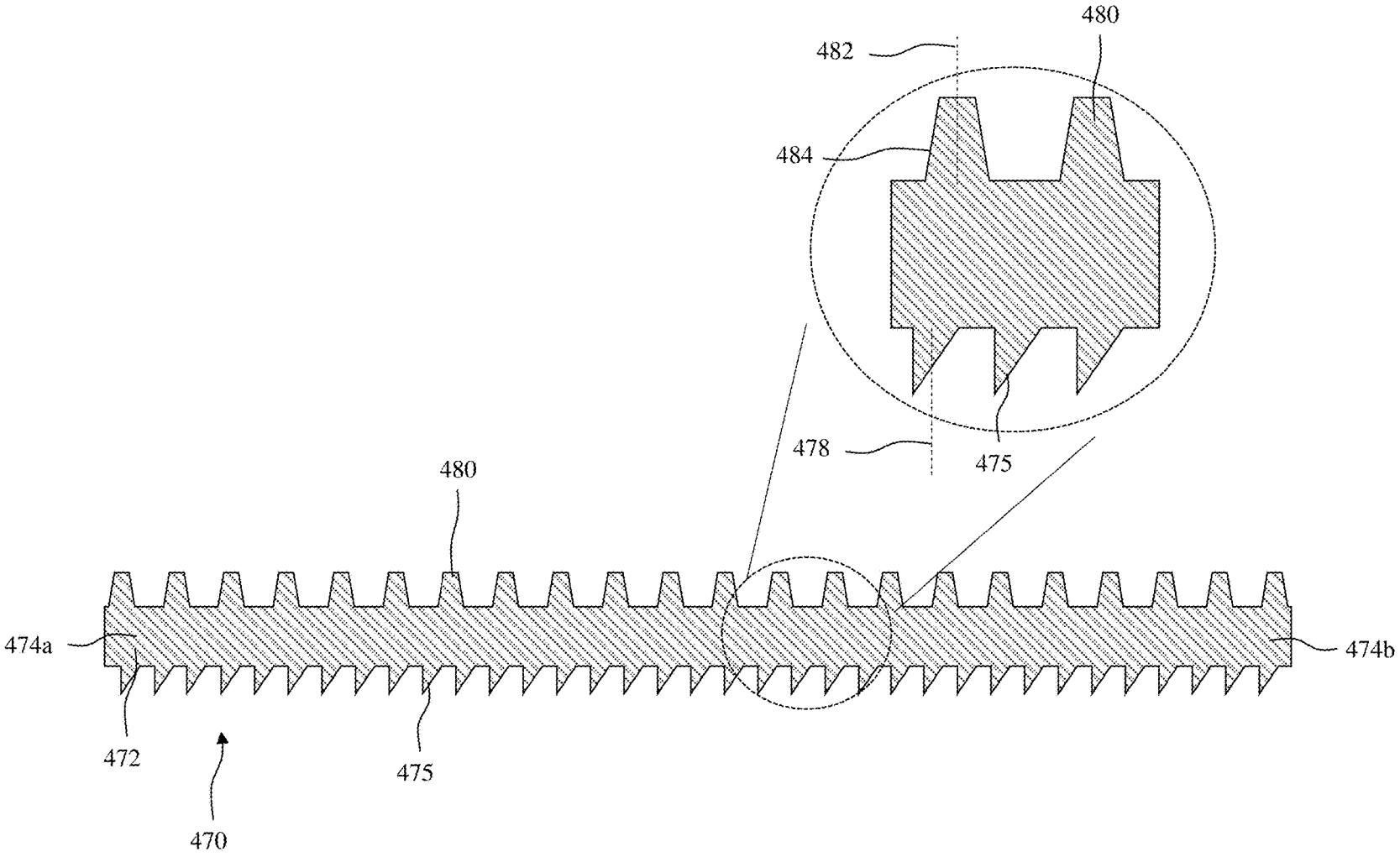
Figure 4E:
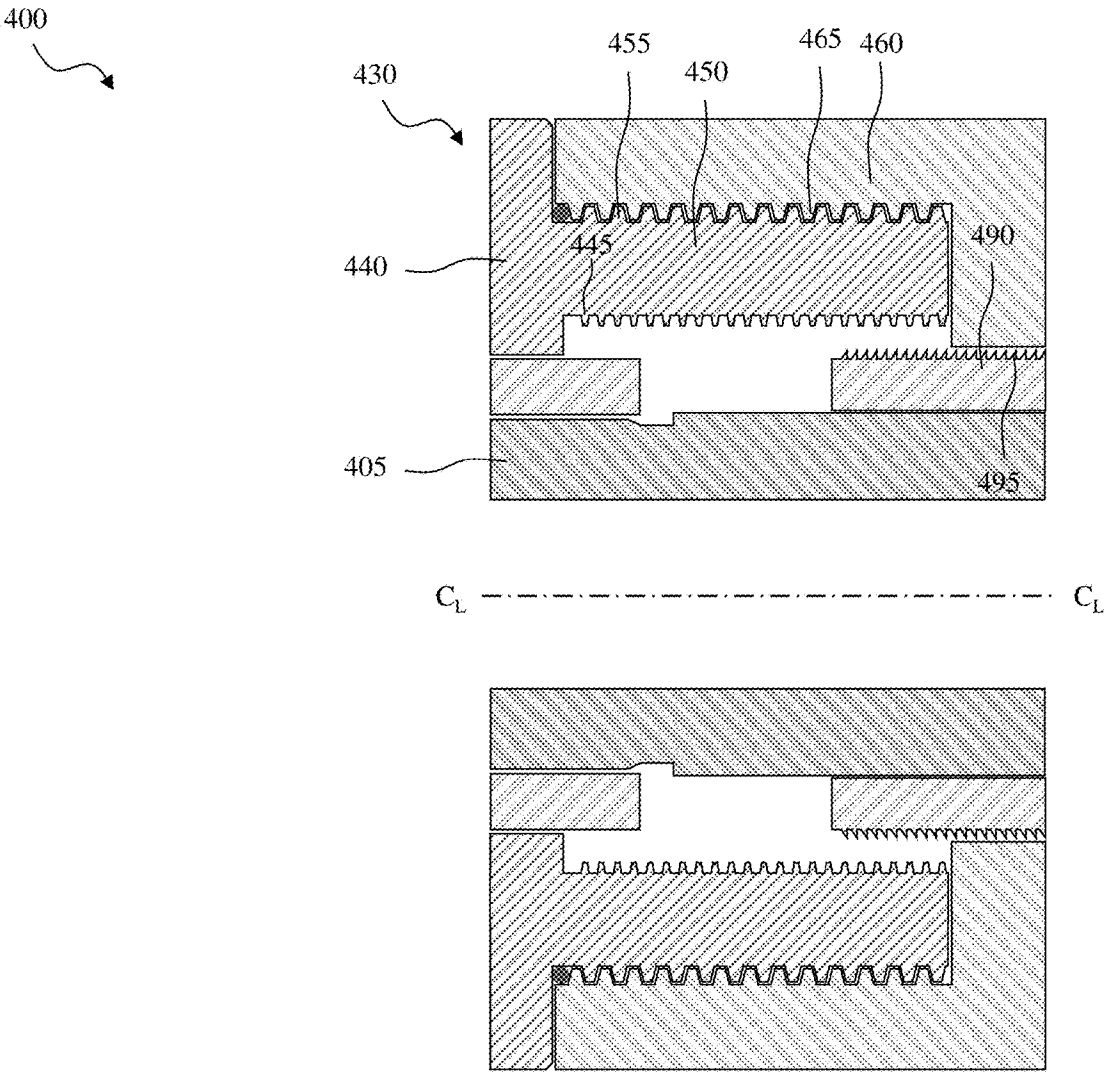
Figure 5A:
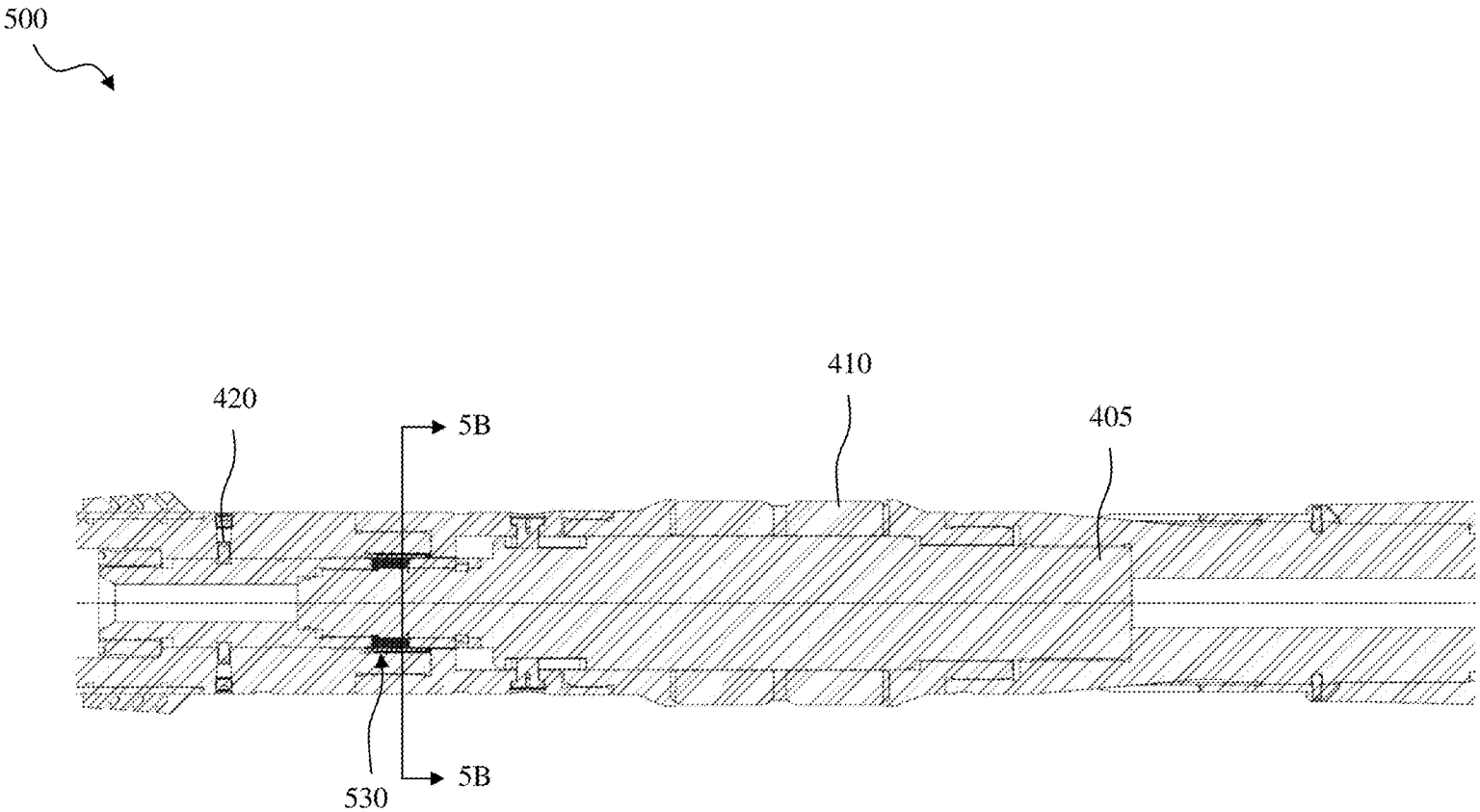
FIGS. 5A through 5E illustrate cross-sectional views of a portion of a sealing/anchoring subassembly designed and manufactured according to one or more alternative embodiments of the disclosure.
Figure 5B:
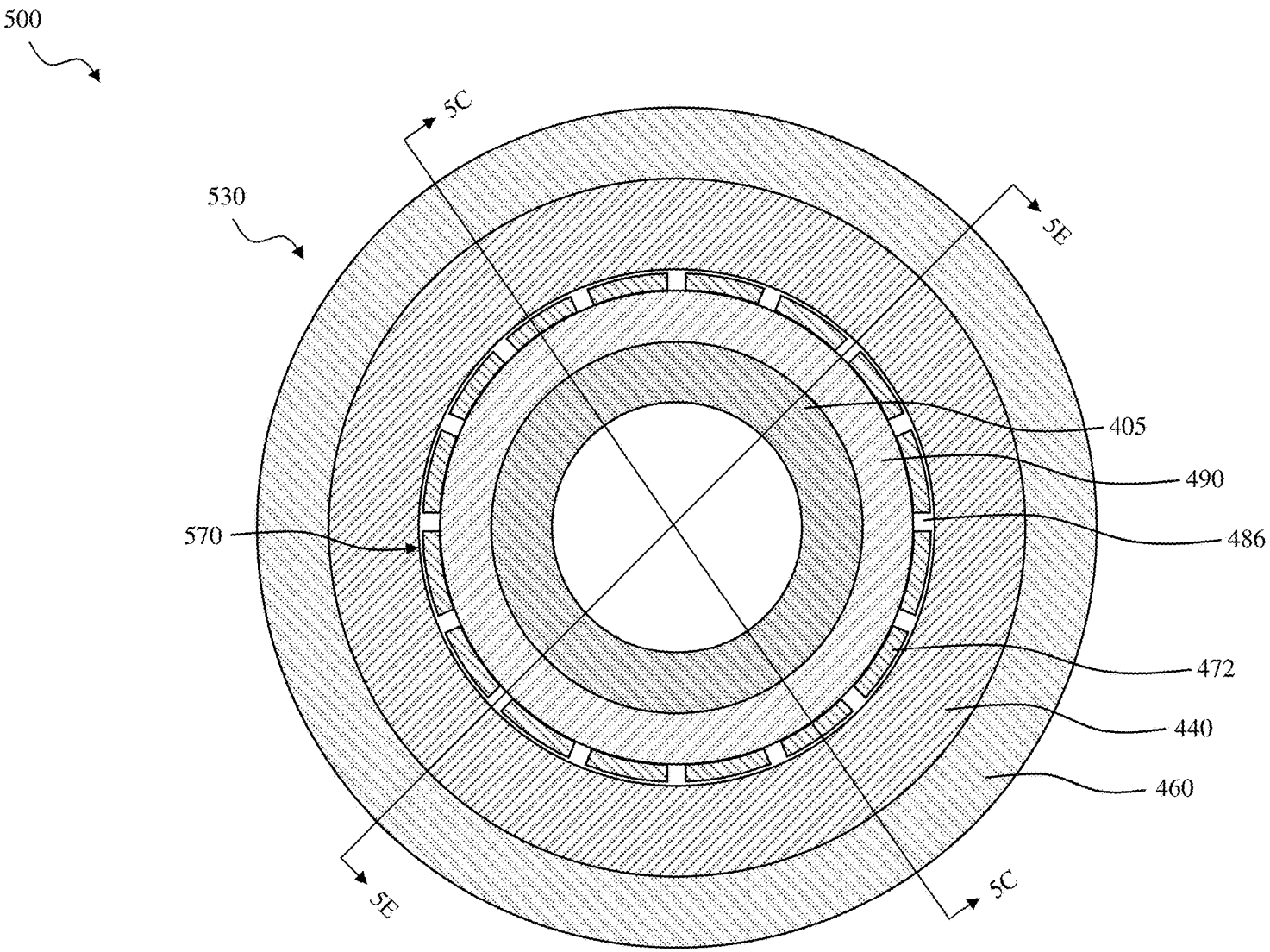
Figure 5C:
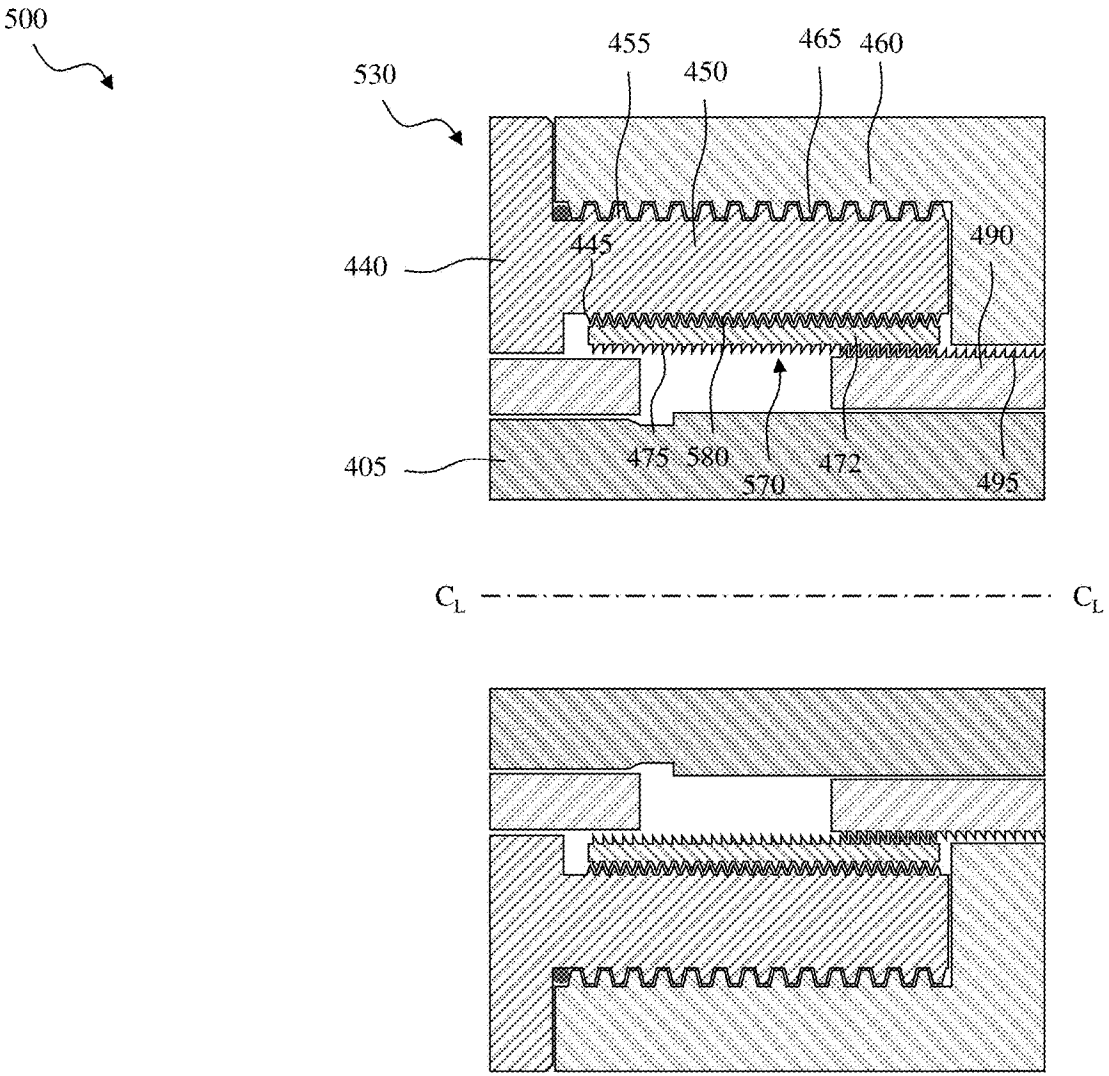
Figure 5D:
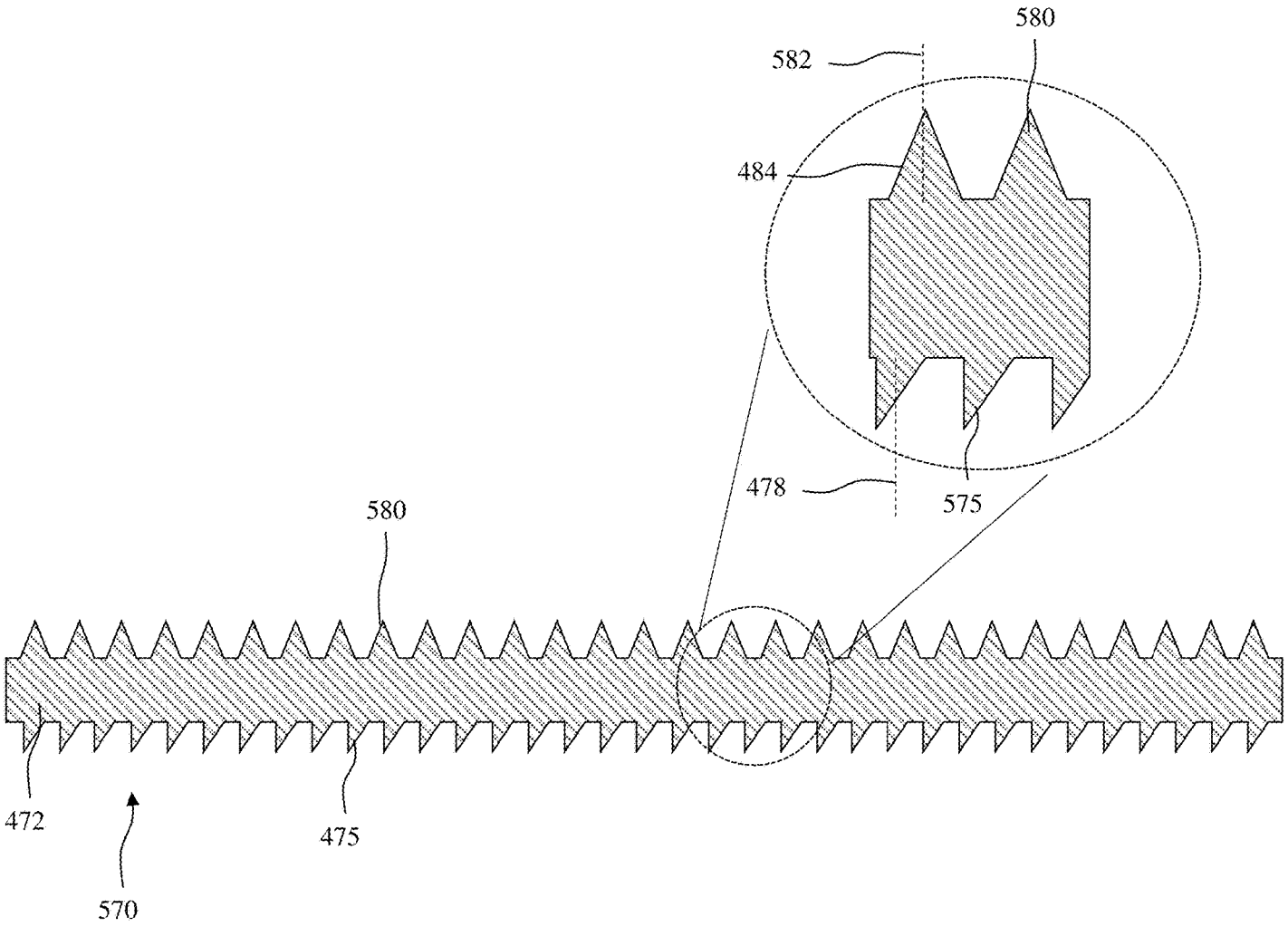
Figure 5E:
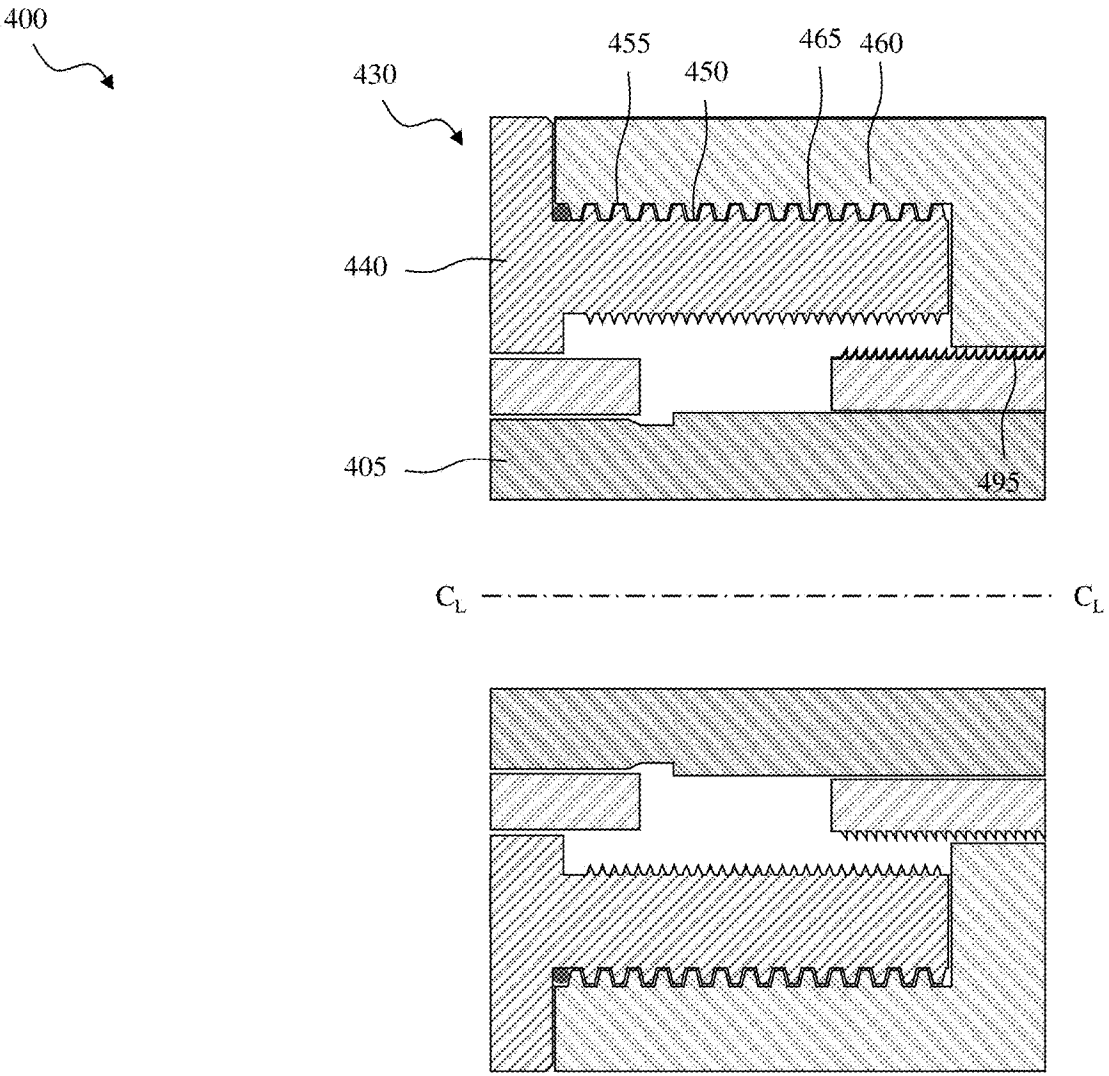
Figure 6A:
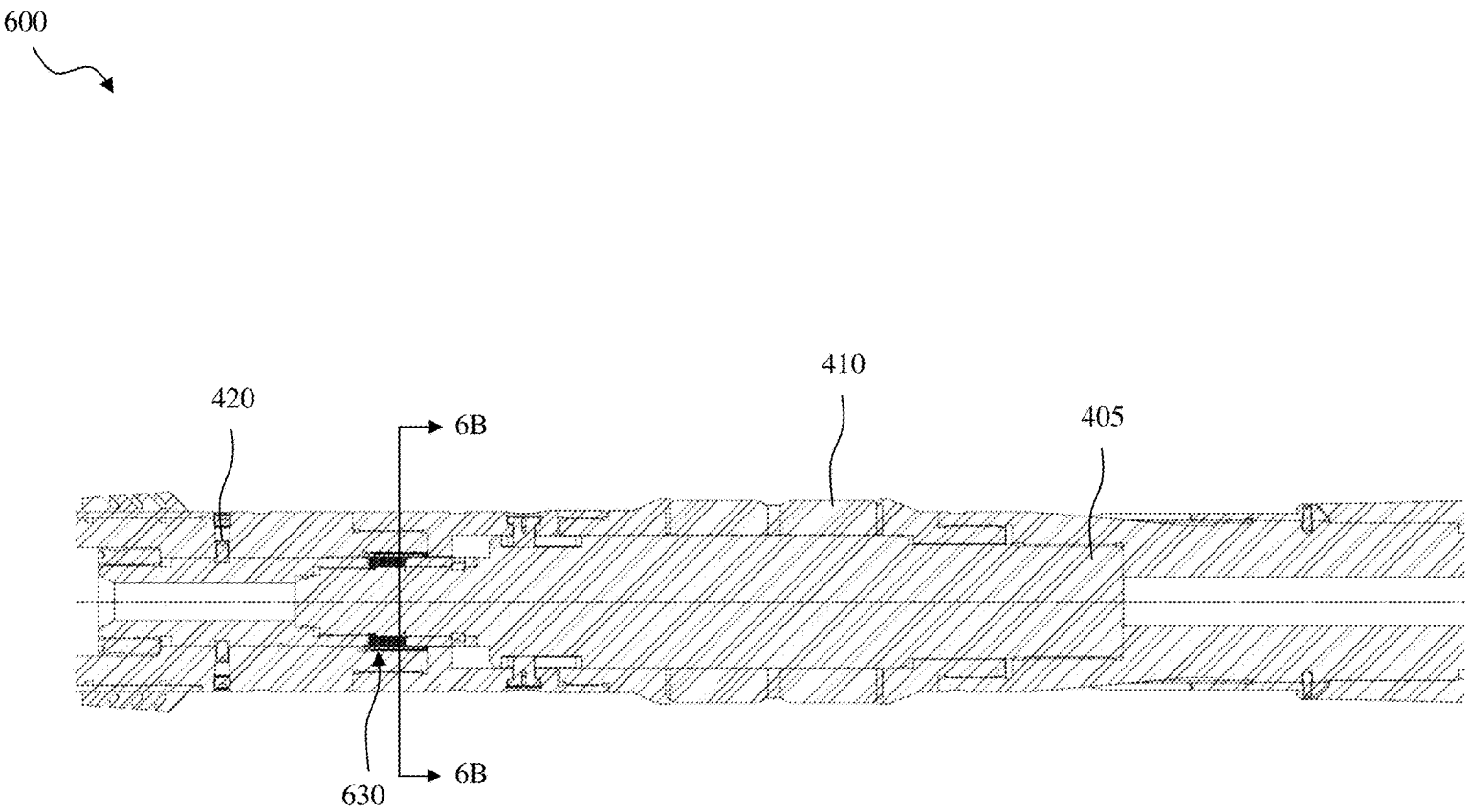
FIGS. 6A through 6E illustrate cross-sectional views of a portion of a sealing/anchoring subassembly designed and manufactured according to one or more alternative embodiments of the disclosure.
Figure 6B:
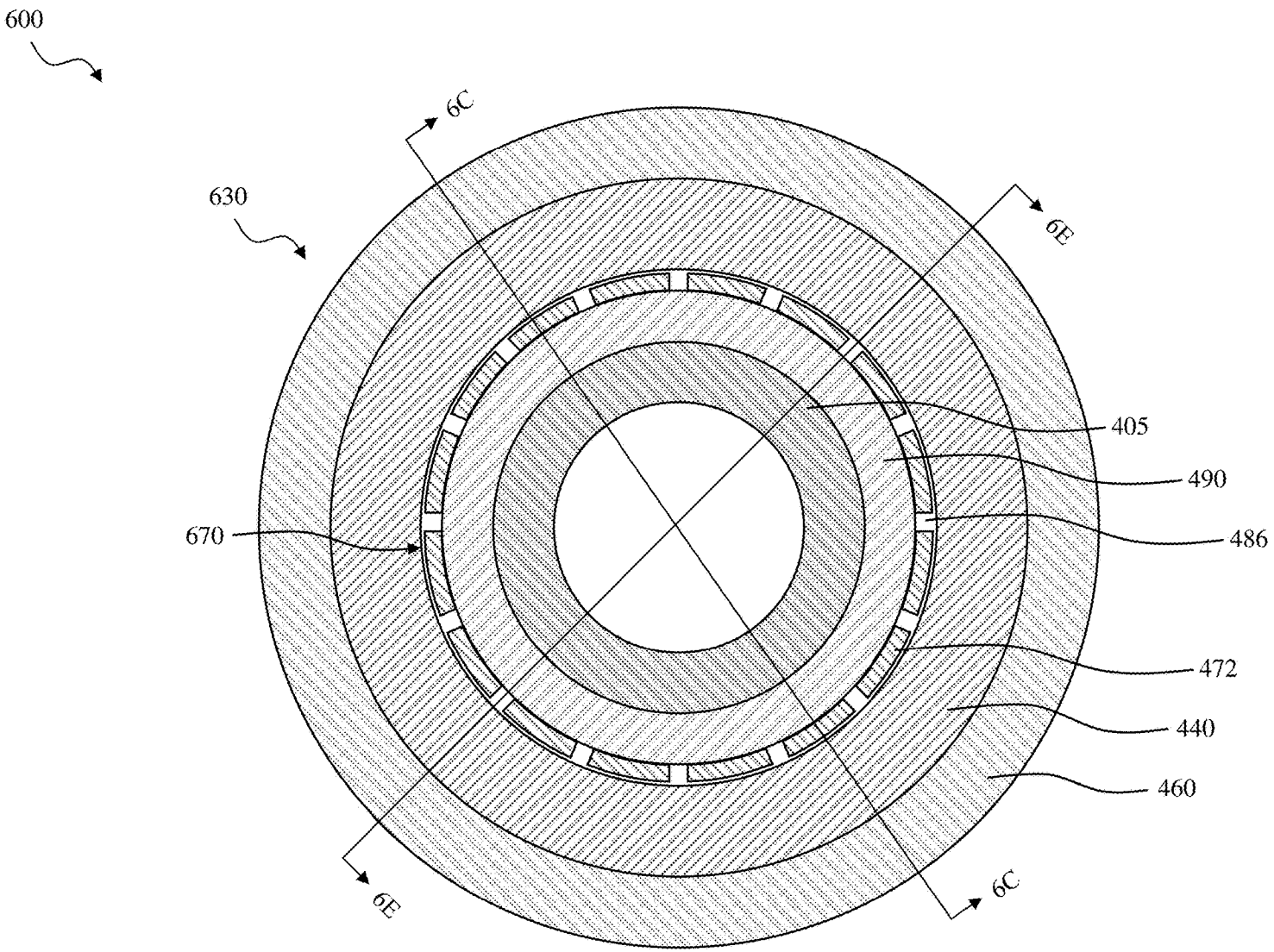
Figure 6C:
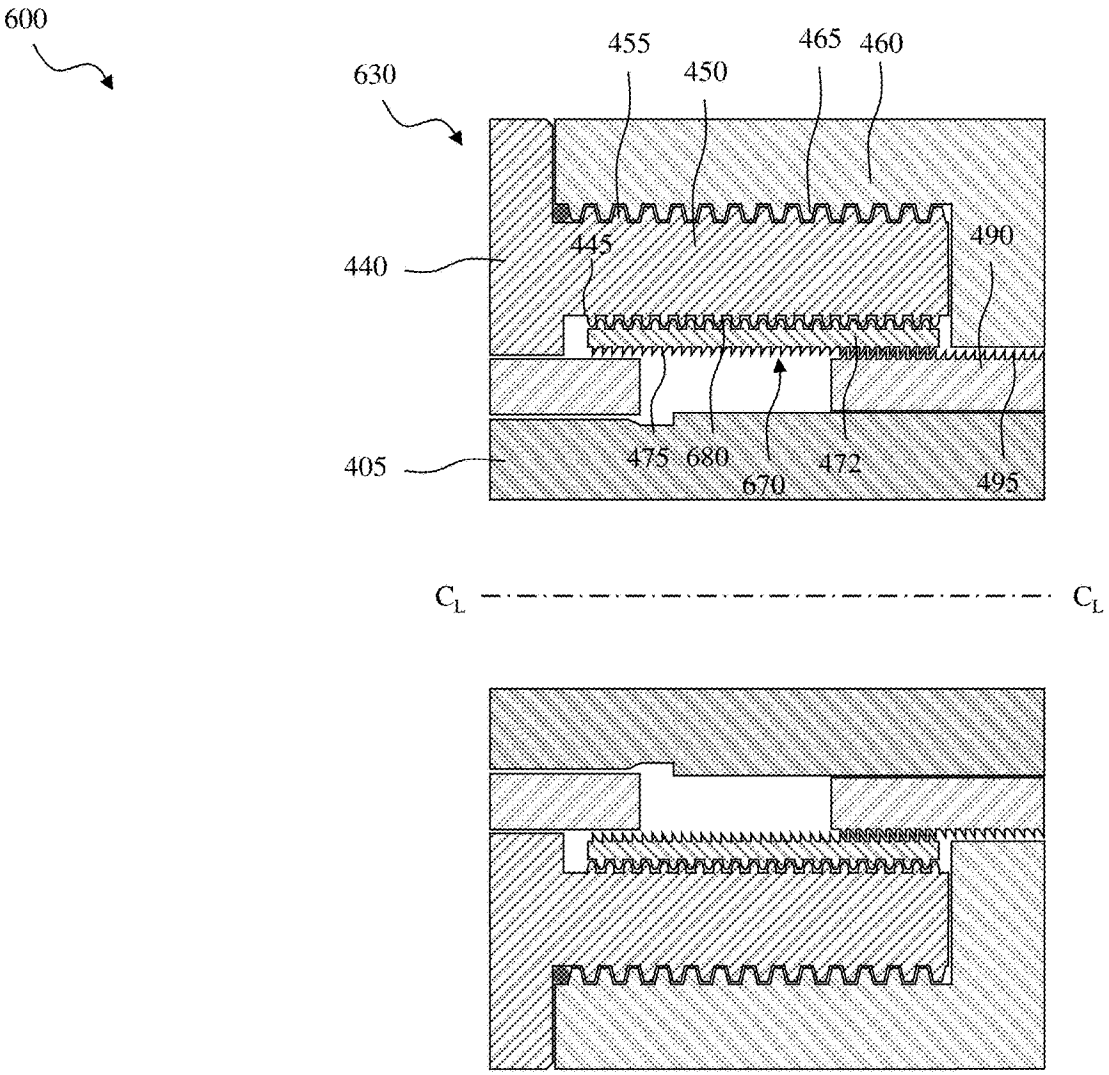
Figure 6D:
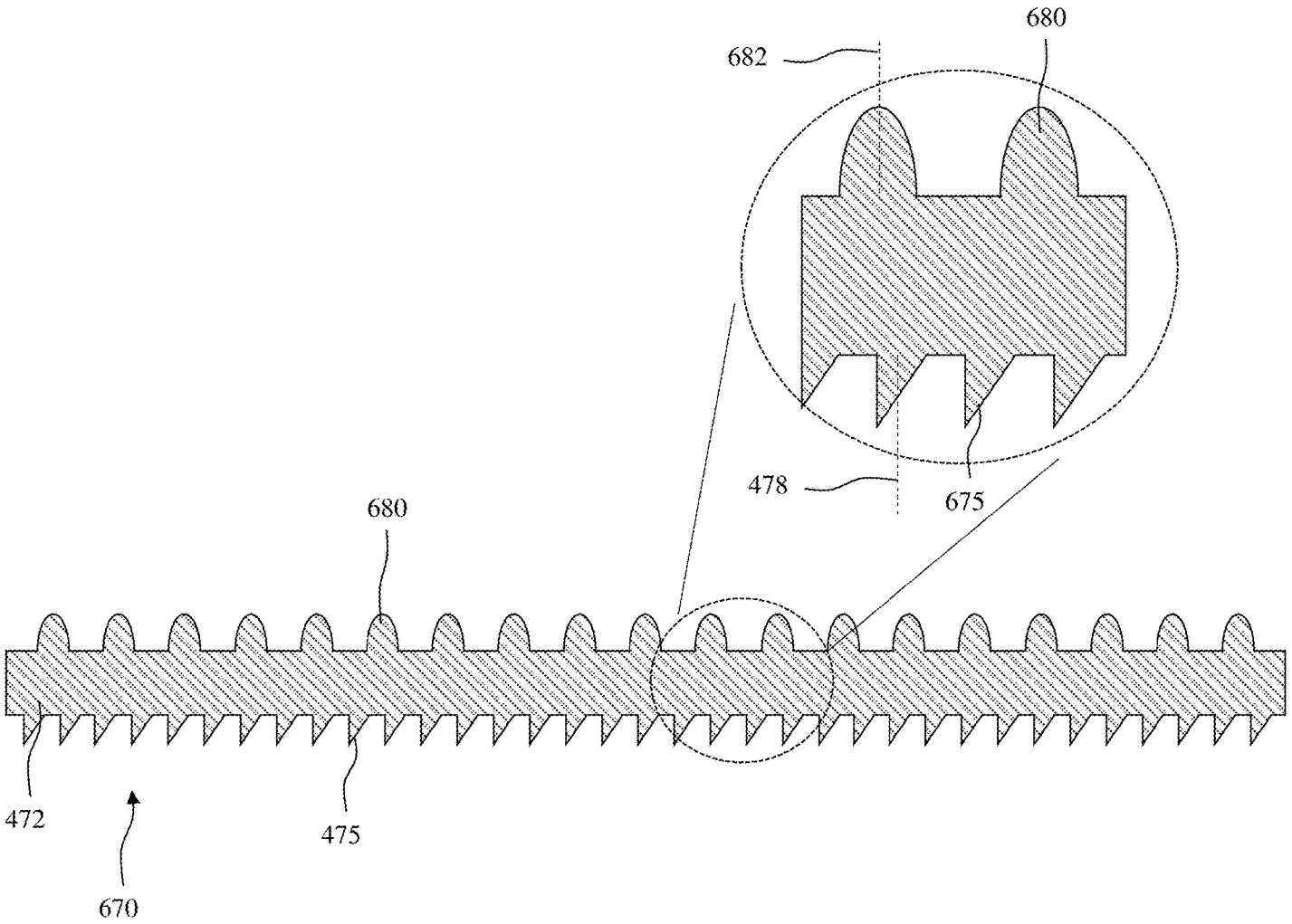
Figure 6E:
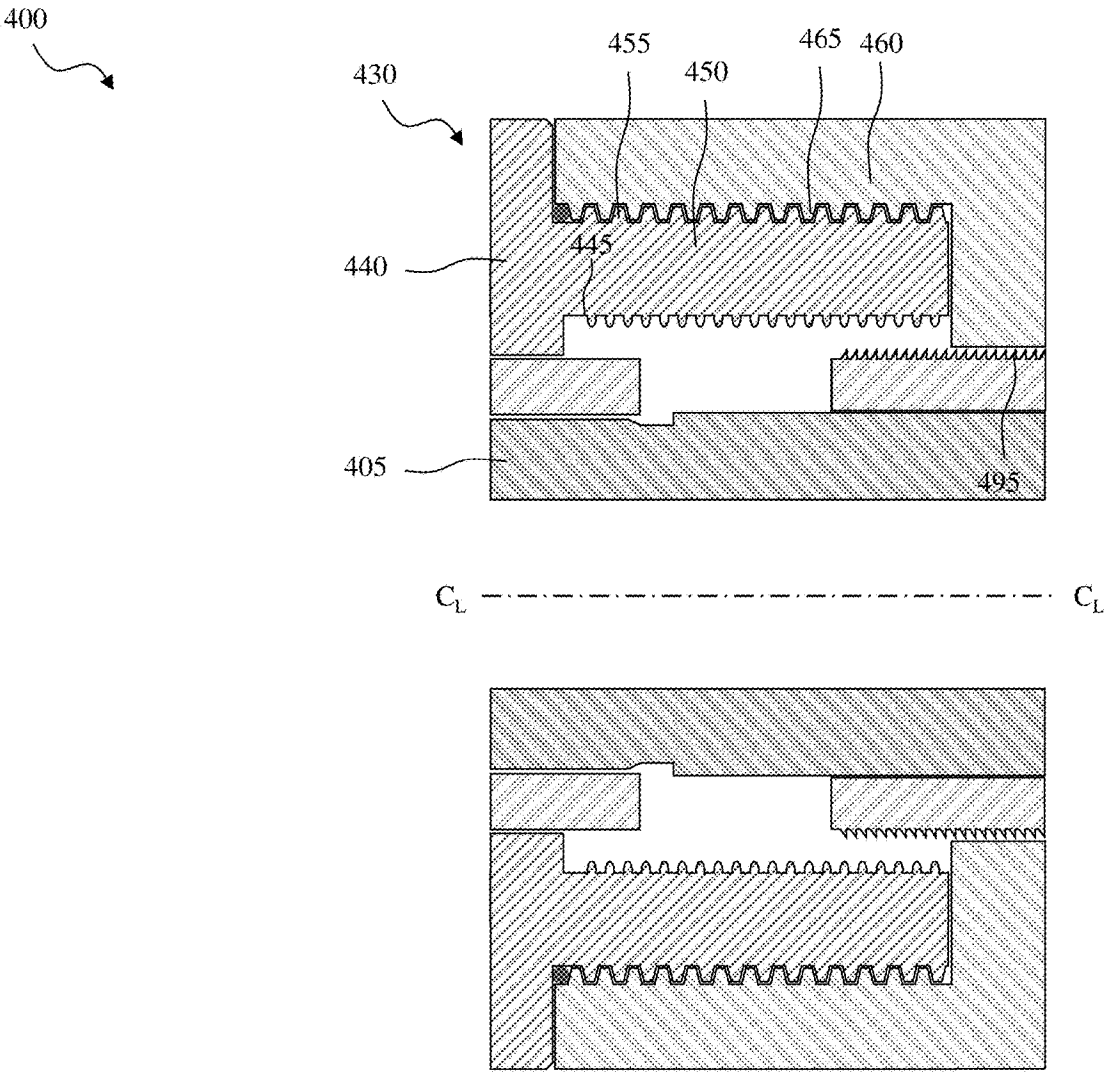

In one or more embodiments, the tubular 472 has a first end 474*a* and a second end 474*b*. In the illustrated embodiment, the tubular 472 is circumferentially discontinuous proximate the second end 474*b* (e.g., as shown in FIG. 4B). For example, in one or more embodiments, the tubular 472 could includes two or more slots 486 (e.g., four/six/eight/ten/twelve or more slots 486 in one embodiment) in the second end 474*b* of the tubular 472, thereby forming the circumferentially discontinuous second end 474*b*. In at least one embodiment, the two or more slots 486 (e.g., four or more slots 486) may be employed to reduce a radial stiffness of the tubular 472. In yet another embodiment, the tubular 472 is circumferentially continuous proximate the first end 474*a* (e.g., not shown in the embodiments of FIGS. 4A through 4E).

Accordingly, in at least one embodiment, the stroke sleeve teeth 445, the second set of teeth 480, the first set of teeth 475, and the base teeth 495 are configured to ratchet along one another to hold the sealing/anchoring element 410 in the radially expanded state. For example, in at least one embodiment the stroke sleeve 440 moves while the base 490 remains fixed (e.g., a fixed base). For example, the base 490 could be fixed (e.g., permanently fixed or releasably fixed) to the mandrel 405 in one or more embodiments. In other embodiments, it may be preferable to have the stroke sleeve 440 remain fixed, while the base 490 moves relative to the fixed stroke sleeve 440.

Turning to FIGS. 5A through 5E, illustrated are cross-sectional views of a sealing/anchoring subassembly 500 designed, manufactured and/or operated according to an alternative embodiment of the disclosure. The sealing/anchoring subassembly 500 is similar in many respects to the scaling/anchoring subassembly 400 illustrated in FIGS. 4A through 4E above. Accordingly, like reference numbers have been used to indicate similar, if not identical, features. The sealing/anchoring subassembly 500 differs, for the most part, from the scaling/anchoring subassembly 400, in that it employs a different ratch latch body 530 employing a different internal slip 570. For example, in the embodiment of FIGS. 5A through 5E, one or more of the second set of teeth 580 that are generally symmetrical about the centerline 582 are in a shape of a triangle.

Turning to FIGS. 6A through 6E, illustrated are cross-sectional views of a sealing/anchoring subassembly 600 designed, manufactured and/or operated according to an alternative embodiment of the disclosure. The sealing/anchoring subassembly 600 is similar in many respects to the sealing/anchoring subassembly 400 illustrated in FIGS. 4A through 4E above. Accordingly, like reference numbers have been used to indicate similar, if not identical, features. The scaling/anchoring subassembly 600 differs, for the most part, from the scaling/anchoring subassembly 400, in that it employs a different ratch latch body 630 employing a different internal slip 670. For example, in the embodiment of FIGS. 6A through 6E, one or more of the second set of teeth 680 that are generally symmetrical about the centerline 682 are in a shape of an arc (e.g., half circle in one embodiment).

Aspects disclosed herein include:

A. A internal slip, the internal slip including: 1) a tubular, the tubular having a tubular inner diameter ($ID_t$) and a tubular outer diameter ($OD_t$); 2) a first set of teeth disposed along the tubular inner diameter ($ID_t$), the first set of teeth configured to engage with base teeth disposed on a base outer diameter ($OD_B$) of a base positioned radially inside of the tubular; and 3) a second set of teeth disposed along the tubular outer diameter ($OD_t$), the second set of teeth configured to engage with stroke sleeve teeth disposed on a stroke sleeve outer diameter ($OD_{SS}$) of a stroke sleeve positioned radially outside of the tubular, wherein one or more of the second set of teeth are generally symmetrical about a centerline thereof.

B. A scaling/anchoring subassembly, the sealing/anchoring subassembly including: 1) a mandrel; 2) a sealing/anchoring element positioned about the mandrel, the isolation element configured to move between a radially retracted state and a radially expanded state; 3) a ratch latch body coupled to the sealing/anchoring element, the ratch latch body configured to hold the sealing/anchoring element in the radially expanded state, the ratch latch body including: a) a stroke sleeve having a stroke sleeve outer diameter ($OD_{SS}$) and a stroke sleeve inner diameter ($ID_{SS}$), the stroke sleeve inner diameter ($ID_{SS}$) having a plurality of stroke sleeve teeth disposed thereon; and b) a base having a base outer diameter ($OD_B$) and a base inner diameter ($ID_B$), the base outer diameter ($OD_B$) having a plurality of base teeth disposed thereon; c) a internal slip disposed radially between the stroke sleeve and the base, the internal slip including: i) a tubular, the tubular having a tubular inner diameter ($ID_t$) and a tubular outer diameter ($OD_t$); ii) a first set of teeth disposed along the tubular inner diameter ($ID_t$), the first set of teeth configured to engage with the base teeth; and iii) a second set of teeth disposed along the tubular outer diameter ($OD_t$), the second set of teeth configured to engage with the stroke sleeve teeth, wherein one or more of the second set of teeth are generally symmetrical about a centerline thereof, and further wherein the stroke sleeve teeth, the second set of teeth, the first set of teeth, and the base teeth are configured to ratchet along one another to hold the sealing/anchoring element in the radially expanded state, the stroke sleeve teeth and the base teeth configured to directly ratchet along one another to hold the sealing/anchoring element in the radially expanded state.

C. A well system, the well system including: 1) a wellbore located in a subterranean formation; and 2) a sealing/anchoring assembly positioned in the wellbore, the sealing/anchoring assembly including: a) a mandrel; b) a sealing/anchoring element positioned about the mandrel, the sealing/anchoring element configured to move between a radially retracted state and a radially expanded state; and c) a ratch latch body coupled to the sealing/anchoring element, the ratch latch body configured to hold the sealing/anchoring element in the radially expanded state, the ratch latch body including: i) a stroke sleeve having a stroke sleeve outer diameter ($OD_{SS}$) and a stroke sleeve inner diameter ($ID_{SS}$), the stroke sleeve inner diameter ($ID_{SS}$) having a plurality of stroke sleeve teeth disposed thereon; and ii) a base having a base outer diameter ($OD_B$) and a base inner diameter ($ID_B$), the base outer diameter ($OD_B$) having a plurality of base teeth disposed thereon; iii) a internal slip disposed radially between the stroke sleeve and the base, the internal slip including: a tubular, the tubular having a tubular inner diameter ($ID_t$) and a tubular outer diameter ($OD_t$); a first set of teeth disposed along the tubular inner diameter ($ID_t$), the first set of teeth configured to engage with the base teeth; and a second set of teeth disposed along the tubular outer diameter ($OD_t$), the second set of teeth configured to engage with the stroke sleeve teeth, wherein one or more of the second set of teeth are generally symmetrical about a centerline thereof, and further wherein the stroke sleeve teeth, the second set of teeth, the first set of teeth, and the base teeth are configured to ratchet along one another to hold the sealing/anchoring element in the radially expanded state, the stroke sleeve teeth and the base teeth configured to directly ratchet along one another to hold the sealing/anchoring element in the radially expanded state.

D. A method, the method including: 1) positioning a sealing/anchoring assembly within a wellbore located in a subterranean formation, the sealing/anchoring assembly including: a) mandrel; b) a sealing/anchoring element positioned about the mandrel, the sealing/anchoring element configured to move between a radially retracted state and a radially expanded state; and c) a ratch latch body coupled to the sealing/anchoring element, the ratch latch body configured to hold the sealing/anchoring element in the radially expanded state, the ratch latch body including: i) a stroke sleeve having a stroke sleeve outer diameter ($OD_{SS}$) and a stroke sleeve inner diameter ($ID_{SS}$), the stroke sleeve inner diameter ($ID_{SS}$) having a plurality of stroke sleeve teeth disposed thereon; and ii) a base having a base outer diameter ($OD_B$) and a base inner diameter ($ID_B$), the base outer diameter ($OD_B$) having a plurality of base teeth disposed thereon; iii) a internal slip disposed radially between the stroke sleeve and the base, the internal slip including: a tubular, the tubular having a tubular inner diameter ($ID_t$) and a tubular outer diameter ($OD_t$); a first set of teeth disposed along the tubular inner diameter ($ID_t$), the first set of teeth configured to engage with the base teeth; and a second set of teeth disposed along the tubular outer diameter ($OD_t$), the second set of teeth configured to engage with the stroke sleeve teeth, wherein one or more of the second set of teeth are generally symmetrical about a centerline thereof, and further wherein the stroke sleeve teeth, the second set of teeth, the first set of teeth, and the base teeth are configured to ratchet along one another to hold the sealing/anchoring element in the radially expanded state, the stroke sleeve teeth and the base teeth configured to directly ratchet along one another to hold the sealing/anchoring element in the radially expanded state; and 2) actuating the stroke sleeve or base to move the sealing/anchoring element from the radially retracted state to the radially expanded state.

Aspects A, B, C, and D may have one or more of the following additional elements in combination: Element 1: wherein the one or more of the second set of teeth are substantially symmetrical about the centerline thereof. Element 2: wherein the one or more of the second set of teeth are ideally symmetrical about the centerline thereof. Element 3: wherein tips of the one or more of the second set of teeth that are generally symmetrical are in a shape of a polygon. Element 4: wherein sidewalls of the tips of the one or more of the second set of teeth that are generally symmetrical are angled relative to the centerline. Element 5: wherein tips of the one or more of the second set of teeth that are generally symmetrical are in a shape of a triangle. Element 6: wherein tips of the one or more of the second set of teeth that are generally symmetrical are in a shape of an arc. Element 7: wherein the first set of teeth are not generally symmetrical about a different centerline thereof. Element 8: wherein the tubular has a first end and a second end, and further wherein the tubular is circumferentially discontinuous proximate the second end. Element 9: wherein the tubular is circumferentially continuous proximate the first end, and further including four or more slots in the second end of the tubular forming the circumferentially discontinuous second end, the four or more slots configured to reduce a radial stiffness of the tubular. Element 10: wherein the wellbore is a main wellbore, and further including a lateral wellbore extending from the main wellbore, the sealing/anchoring assembly positioned proximate an intersection between the main wellbore and the lateral wellbore.

Those skilled in the art to which this application relates will appreciate that other and further additions, deletions, substitutions and modifications may be made to the described embodiments.

What is claimed is:

1. A sealing/anchoring subassembly, comprising:

a mandrel;

a sealing/anchoring element positioned about the mandrel, the sealing/anchoring element configured to move between a radially retracted state and a radially expanded state; and a ratch latch body coupled to the sealing/anchoring element, the ratch latch body configured to hold the sealing/anchoring element in the radially expanded state, the ratch latch body including:

a stroke sleeve having a stroke sleeve outer diameter ($OD_{SS}$) and a stroke sleeve inner diameter ($ID_{SS}$), the stroke sleeve inner diameter ($ID_{SS}$) having a plurality of stroke sleeve teeth disposed thereon;

a base having a base outer diameter ($OD_B$) and a base inner diameter ($ID_B$), the base outer diameter ($OD_B$) having a plurality of base teeth disposed thereon;

an internal slip disposed radially between the stroke sleeve and the base, the internal slip including:

a tubular, the tubular having a tubular inner diameter ($ID_t$), a tubular outer diameter ($OD_t$), a first end and a second end, wherein the tubular is circumferentially continuous proximate the first end and circumferentially discontinuous proximate the second end, the circumferentially discontinuous second end configured to reduce a radial stiffness of the tubular;

a first set of teeth disposed along the tubular inner diameter ($ID_t$), the first set of teeth configured to engage with the base teeth; and a second set of teeth disposed along the tubular outer diameter ($OD_t$), the second set of teeth configured to engage with the stroke sleeve teeth, wherein the stroke sleeve teeth, the second set of teeth, the first set of teeth, and the base teeth are configured to ratchet along one another to hold the sealing/anchoring element in the radially expanded state.

2. The sealing/anchoring subassembly as recited in claim 1, wherein tips of the one or more of the second set of teeth are in a shape of a polygon.

3. The sealing/anchoring subassembly as recited in claim 2, wherein sidewalls of the tips of the one or more of the second set of teeth are angled relative to a centerline.

4. The sealing/anchoring subassembly as recited in claim 1, wherein tips of the one or more of the second set of teeth are in a shape of a triangle.

5. The sealing/anchoring subassembly as recited in claim 1, wherein tips of the one or more of the second set of teeth are in a shape of an arc.

6. The sealing/anchoring subassembly as recited in claim 1, wherein the second set of teeth are not symmetrical about a centerline thereof.

7. The sealing/anchoring subassembly as recited in claim 1, further including four or more slots in the second end of the tubular forming the circumferentially discontinuous second end, the four or more slots configured to reduce a radial stiffness of the tubular.

8. A well system, comprising:

a wellbore located in a subterranean formation; and a sealing/anchoring assembly positioned in the wellbore, the sealing/anchoring assembly including:

a mandrel;

a sealing/anchoring element positioned about the mandrel, the sealing/anchoring element configured to move between a radially retracted state and a radially expanded state; and a ratch latch body coupled to the sealing/anchoring element, the ratch latch body configured to hold the sealing/anchoring element in the radially expanded state, the ratch latch body including:

a stroke sleeve having a stroke sleeve outer diameter ($OD_{SS}$) and a stroke sleeve inner diameter ($ID_{SS}$), the stroke sleeve inner diameter ($ID_{SS}$) having a plurality of stroke sleeve teeth disposed thereon;

a base having a base outer diameter ($OD_B$) and a base inner diameter ($ID_B$), the base outer diameter ($OD_B$) having a plurality of base teeth disposed thereon;

an internal slip disposed radially between the stroke sleeve and the base, the internal slip including:

a tubular, the tubular having a tubular inner diameter ($ID_t$), a tubular outer diameter ($OD_t$), a first end and a second end, wherein the tubular is circumferentially continuous proximate the first end and circumferentially discontinuous proximate the second end, the circumferentially discontinuous second end configured to reduce a radial stiffness of the tubular;

a first set of teeth disposed along the tubular inner diameter ($ID_t$), the first set of teeth configured to engage with the base teeth; and a second set of teeth disposed along the tubular outer diameter ($OD_t$), the second set of teeth configured to engage with the stroke sleeve teeth, wherein the stroke sleeve teeth, the second set of teeth, the first set of teeth, and the base teeth are configured to ratchet along one another to hold the sealing/anchoring element in the radially expanded state.

9. The well system as recited in claim 8, wherein the wellbore is a main wellbore, and further including a lateral wellbore extending from the main wellbore, the sealing/anchoring assembly positioned proximate an intersection between the main wellbore and the lateral wellbore.

10. A method, comprising:

positioning a sealing/anchoring assembly within a wellbore located in a subterranean formation, the sealing/anchoring assembly including:

a mandrel;

a sealing/anchoring element positioned about the mandrel, the sealing/anchoring element configured to move between a radially retracted state and a radially expanded state; and a ratch latch body coupled to the sealing/anchoring element, the ratch latch body configured to hold the sealing/anchoring element in the radially expanded state, the ratch latch body including:

a stroke sleeve having a stroke sleeve outer diameter ($OD_{SS}$) and a stroke sleeve inner diameter ($ID_{SS}$), the stroke sleeve inner diameter ($ID_{SS}$) having a plurality of stroke sleeve teeth disposed thereon;

a base having a base outer diameter ($OD_B$) and a base inner diameter ($ID_B$), the base outer diameter ($OD_B$) having a plurality of base teeth disposed thereon;

an internal slip disposed radially between the stroke sleeve and the base, the internal slip including:

a tubular, the tubular having a tubular inner diameter ($ID_t$), a tubular outer diameter ($OD_t$), a first end and a second end, wherein the tubular is circumferentially continuous proximate the first end and circumferentially discontinuous proximate the second end, the circumferentially discontinuous second end configured to reduce a radial stiffness of the tubular;

a first set of teeth disposed along the tubular inner diameter ($ID_t$), the first set of teeth configured to engage with the base teeth; and a second set of teeth disposed along the tubular outer diameter ($OD_t$), the second set of teeth configured to engage with the stroke sleeve teeth, wherein the stroke sleeve teeth, the second set of teeth, the first set of teeth, and the base teeth are configured to ratchet along one another to hold the sealing/anchoring element in the radially expanded state; and actuating the stroke sleeve or base to move the sealing/anchoring element from the radially retracted state to the radially expanded state.

* * * * *